US005758585A

United States Patent [19]

Latchinian

[11] Patent Number: 5,758,585

[45] Date of Patent: Jun. 2, 1998

[54] SHELVING SYSTEM

[76] Inventor: Jim S. Latchinian, 5701 Miami Lakes Dr. E., Miami Lakes, Fla. 33014

[21] Appl. No.: 788,282

[22] Filed: Jan. 24, 1997

[51] Int. Cl.[6] ..... A47B 85/00

[52] U.S. Cl. ..... 108/23; 362/127; 108/108

[58] Field of Search ..... 108/23, 108; 362/127, 362/125, 217

[56] References Cited

U.S. PATENT DOCUMENTS

| | | | |
|---|---|---|---|
| 2,838,355 | 6/1958 | Crowther | 108/23 X |
| 2,887,802 | 5/1959 | Burmeister | 108/23 X |
| 3,613,604 | 10/1971 | Butler | 108/23 X |
| 3,664,063 | 5/1972 | Ware | 108/23 X |
| 4,994,943 | 2/1991 | Aspenwall . | |
| 5,205,638 | 4/1993 | Squitieri | 108/23 X |
| 5,626,084 | 5/1997 | Kelly et al. | 108/23 |

FOREIGN PATENT DOCUMENTS

| | | | |
|---|---|---|---|
| 1379276 | 1/1975 | United Kingdom | 108/23 |
| 2255820 | 11/1992 | United Kingdom | 108/23 |

*Primary Examiner*—Jose V. Chen
*Attorney, Agent, or Firm*—Oltman, Flynn & Kubler

[57] ABSTRACT

A shelving system includes a power track having an electric circuit connected to a power source, and at least one shelf structure including a top panel and containing a light source beneath the top panel to radiate light to the shelf structure immediately below it, the shelf structure being removably fitted to the power track so that the light source is electrically connected to the electric circuit. The shelf structure preferably includes a pair of laterally spaced apart shelf brackets having structures for receiving and retaining the top panel, a forward nose piece secured over the forward longitudinal edge of said top panel, the forward nose piece including opposing, slotted plate receiving beads; so that the forward longitudinal edge of the top panel fits against the beads, an elongate light source mounting plate fitted longitudinally and engagingly into the slot in the opposing beads beneath the top panel, a pair of spaced apart bulb mounting socket structures projecting from the mounting plate and a light source ballast structure, and a circuit having a conductive shelf coupling structure and extending from the ballast structure to one of the socket structures, and from the ballast structure to the power source.

10 Claims, 9 Drawing Sheets

210
10
260
232
212
222
240
15
210
216
15
288
232
216
290
10
212
222
210
232
310
212
240
260
240
222
232
232
222
240
232
212
240
222
232
210
212
232
216
244
242
246
246
242
244
240

SHELVING SYSTEM

BACKGROUND OF THE INVENTION

1. Field of the Invention

The present invention relates generally to the field of shelves and merchandise display structures. More specifically the present invention relates to a highly adaptable shelving system including several shelf members with shelf member anchoring structures and shelf support tracks, each shelf support track having a series of corresponding shelf anchor engaging structures.

One embodiment of the present invention includes several modular illuminating shelf structures, each of which casts light on the shelf structure immediately below it. Each shelf structure has a top panel which is preferably opaque and which contains a light source. The shelf structure is removably plugged into a power track containing an electric circuit, which may be separate from the support tracks. As a result, electric power is automatically connected to the shelf structure light source upon mounting of the individual shelf structure, permitting rapid and convenient rearrangement of shelf structures.

Each shelf structure either includes a translucent bottom panel which is spaced downwardly from the opaque top panel or is simply open underneath. Shelf brackets receive and retain within receiving channels extending along their inner faces the top panel and bottom panel in their spaced apart configuration. An opaque channel-shaped forward nose piece is secured over the forward longitudinal edges of the top and bottom panels. The forward nose piece includes opposing, slotted plate receiving beads extending along the inside of each longitudinal edge.

An elongate bulb mounting plate is fitted longitudinally into the bead slots and is of sufficient width to be retained by beads. A pair of longitudinally spaced apart bulb mounting socket structures protrude rearwardly and internally from the mounting plate. Along one of the shelf brackets extends a conventional fluorescent or halogen bulb ballast structure, circuit wires extending from the ballast structure to the nearest socket structure, and from the ballast structure to a track circuit engaging plug having conductive prongs. Prong receiving receptacles are provided periodically along the track and are connected to the track circuit.

2. Description of the Prior Art

There have long been shelving systems for retaining items of all sorts, such as books and ornamental plates, in the home and the office. Various display structures have also been developed for the commercial display of items to be sold. A problem with these shelving systems and display structures has been their lack of visual appeal and lack of versatility and adaptability to a wide variety of uses and environments.

It is thus an object of the present invention to provide a shelving system which is suitable for displaying many different types of items in a commercial setting.

It is another object of the present invention to provide such a system which can be readily assembled, disassembled, configured and reconfigured as required.

It is another object of the present invention to provide such a system having modular illuminating shelves which are plugged in as they are mounted to support tracks, so that the cost of rewiring is saved.

It is still another object of the present invention to provide such a system which is sturdy and visually appealing.

It is finally an object of the present invention to provide such a system which is inexpensive to manufacture.

SUMMARY OF THE INVENTION

The present invention accomplishes the above-stated objectives, as well as others, as may be determined by a fair reading and interpretation of the entire specification.

A modular, illuminated shelving system includes a power track including an electric circuit connected to a power source, and at least one shelf structure including a top panel and containing a light source beneath the top panel to radiate light onto the shelf structure immediately below, the shelf structure being removably fitted to the power track so that the light source is electrically connected to the electric circuit.

The shelf structure preferably includes a pair of laterally spaced apart shelf brackets having structures for receiving and retaining the top panel, a forward nose piece secured over the forward longitudinal edge of said top panel, the forward nose piece including opposing, slotted plate receiving beads, so that the forward longitudinal edge of the top panel fits against the beads, an elongate light source mounting plate fitted longitudinally and engagingly into the slot in the opposing beads beneath the top panel, a pair of spaced apart bulb mounting socket structures projecting from the mounting plate and a light source ballast structure, and a circuit having a conductive shelf coupling structure and extending from the ballast structure to one of the socket structures, and from the ballast structure to the power source.

The shelf structure optionally includes a translucent bottom panel spaced downwardly from the top panel, a pair of laterally spaced apart shelf brackets having structures for receiving and retaining the top and bottom panels in their spaced apart relationship, a forward nose piece secured over the forward longitudinal edges of the top and bottom panels, the forward nose piece including opposing, slotted plate receiving beads, so that the forward longitudinal edges of the top and bottom panels each fit against the beads, an elongate light source mounting plate fitted longitudinally and engagingly into the slot in the opposing beads, a pair of longitudinally spaced apart bulb mounting socket structures projecting inwardly from the mounting plate, a light source ballast structure, an electric circuit extending from the ballast structure to one of the socket structures, and from the ballast structure to a power source having a conductive shelf coupling structure.

The shelf brackets are optionally translucent. The power source is preferably an electric power track. The shelving system preferably additionally includes at least two shelf structure support tracks. The forward longitudinal edges of the top and bottom panels and the forward nose piece are correspondingly bowed outwardly. The forward nose piece optionally includes an opening defining a display region and a translucent member extends over the opening and is marked with a design which is illuminated by the light source. The forward nose piece and the plate have preferably have registering display openings, and additionally include a translucent sign channel which fits snugly over the forward nose piece, including longitudinal lips which engagingly snap over and around the rear edges of the forward nose piece, and a design on the sign channel registering with the forward nose piece opening, so that light from the bulb is radiated through the region and illuminates the design. The light source bulb is preferably a fluorescent bulb.

A shelving system is further provided including several shelf members, each shelf member including an item supporting planar member with a rearward end, an upright back panel having back panel edges, for removably fitting between the planar member rearward ends, several shelf member anchoring structures, at least one anchoring structure being provided for each shelf member, each anchoring structure including in lateral cross-section a substantially C-shaped portion having upper and lower horizontal segments for receiving between them one planar member and opening lips with mutually diverging vertical lip flanges defining upper and lower lip channels for receiving the back panel edges, and a locking flange extending upwardly from the upper horizontal segment, at least one shelf track in the form of an L-shaped member including a backboard abutment wing and a shelf member engagement wing, the backboard abutment wing including backboard fastening element, the shelf member engagement wing including a series of cut out anchoring structure engaging receptacles, each receptacle including a C-shaped region for receiving the C-shaped portion of one of the anchoring structures, and a locking notch opening upwardly into the top of the upper horizontal segment for receiving the locking flange, so that the anchoring structure is pivoted into the region on the locking flange about the locking notch.

The shelving system preferably additionally includes a substantially vertical track abutment flange extending downwardly from the lower horizontal segment. The C-shaped region preferably includes a forward upper corner and where the forward upper corner is cut away to permit pivoting of the anchoring structure into the region along a downward angle.

A shelving system is also provided, including several pairs of shelf brackets for removably fitting and locking into vertical tracks, where each shelf bracket includes a horizontally elongate panel, having a forward end and having a rearward end with an upper engaging hook portion and a lower engaging hook portion, the upper and lower engaging hook portions each opening downwardly, at least one track including a vertically elongate plate having a series of track slots, a vertical plate receiving structure having a substantially C-shaped cross-section and an opposing pair of notches for longitudinally receiving the elongate plate, the plate receiving structure having opposing longitudinal channels recessed into its outer surface, and a C-shaped wall mounting structure for longitudinally receiving the plate receiving structure and including a pair of opposing, inwardly directed longitudinal beads engaging the opposing longitudinal channels in the plate receiving member, a fastener element for securing the wall mounting structure to a backboard structure to mount the system.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
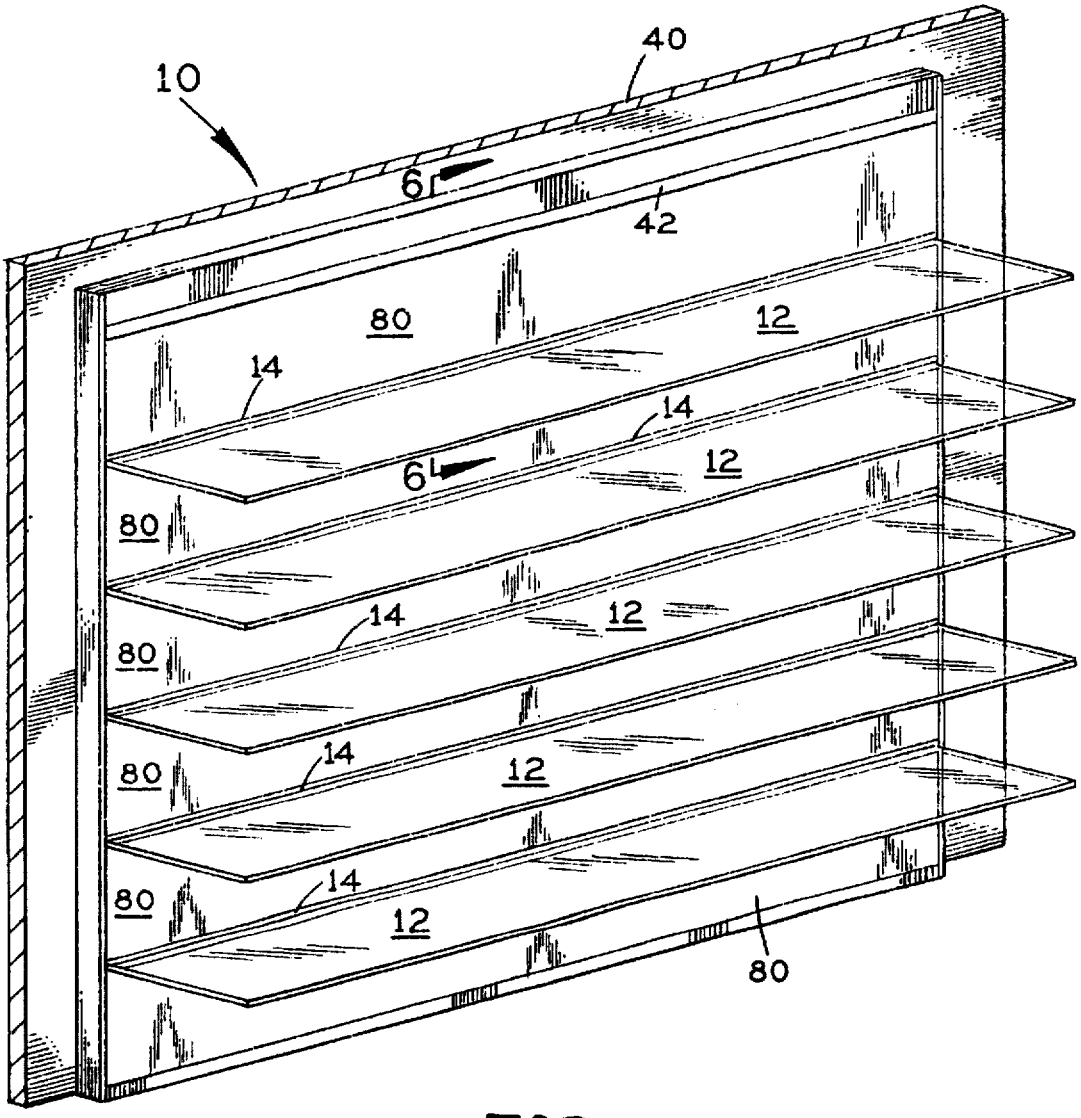
FIG. 1 is a perspective view of the first embodiment of the inventive shelving system.
Figures 2, 3, 4, 5:
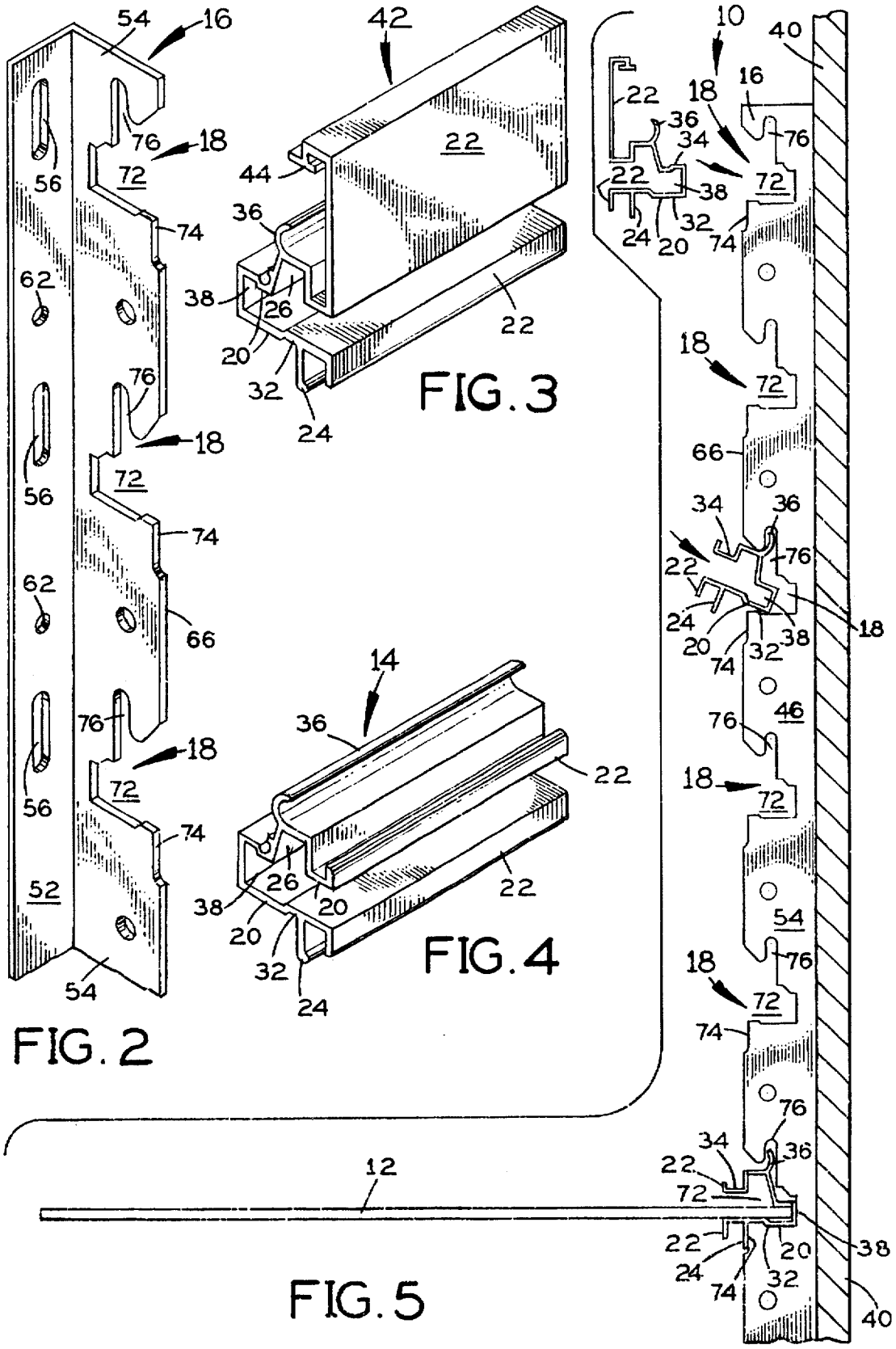
FIG. 2 is a perspective view of an L-shaped track of the first embodiment, illustrating the various cut-out portions defining wall fastener receiving ports and shelf anchoring engaging structure receptacles.
FIG. 3 is a perspective view of the shelf anchoring structure for the topmost track receptacle.
FIG. 4 is a perspective view of the shelf anchoring structure for all track receptacles except the topmost receptacle.
FIG. 5 is a side view of a backboard in cross-section, a track fastened to the backboard, one anchoring structure fully inserted into a track receptacle and containing a shelf member, and an anchoring structure being pivoted into a receptacle, and a topmost anchoring structure ready for pivoting into a receptacle.
Figure 6:
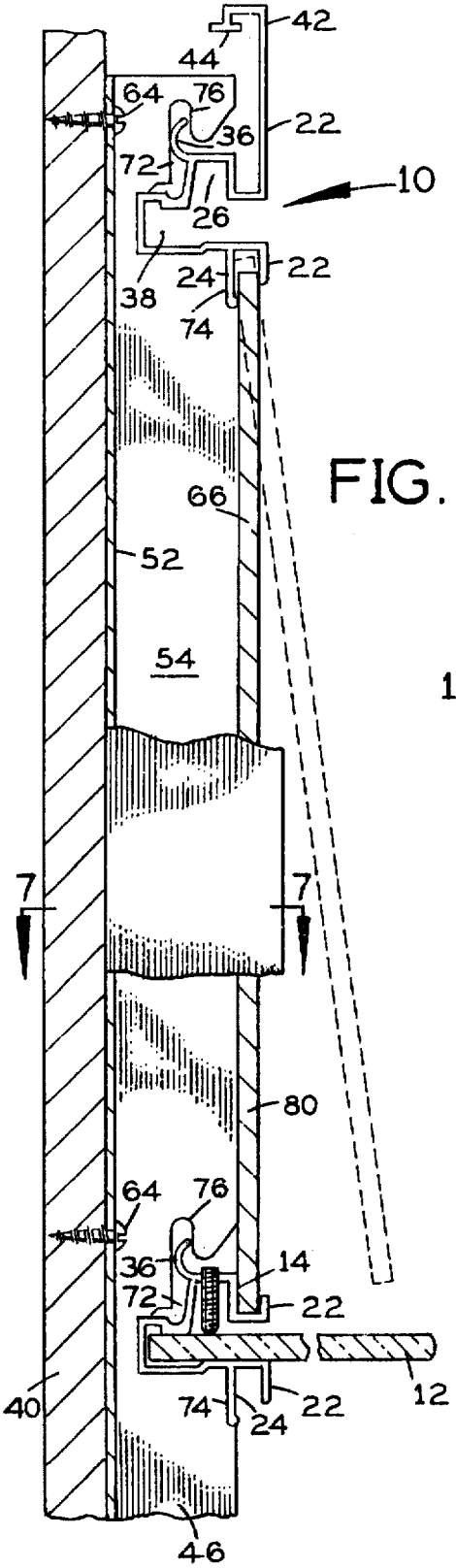
FIG. 6 is a side view of the shelving system of the first embodiment with two anchoring structures in place in the track receptacles, and a backing panel being inserted and pivoted into place within the channels defined by the anchoring structure lip flanges.
Figure 7:
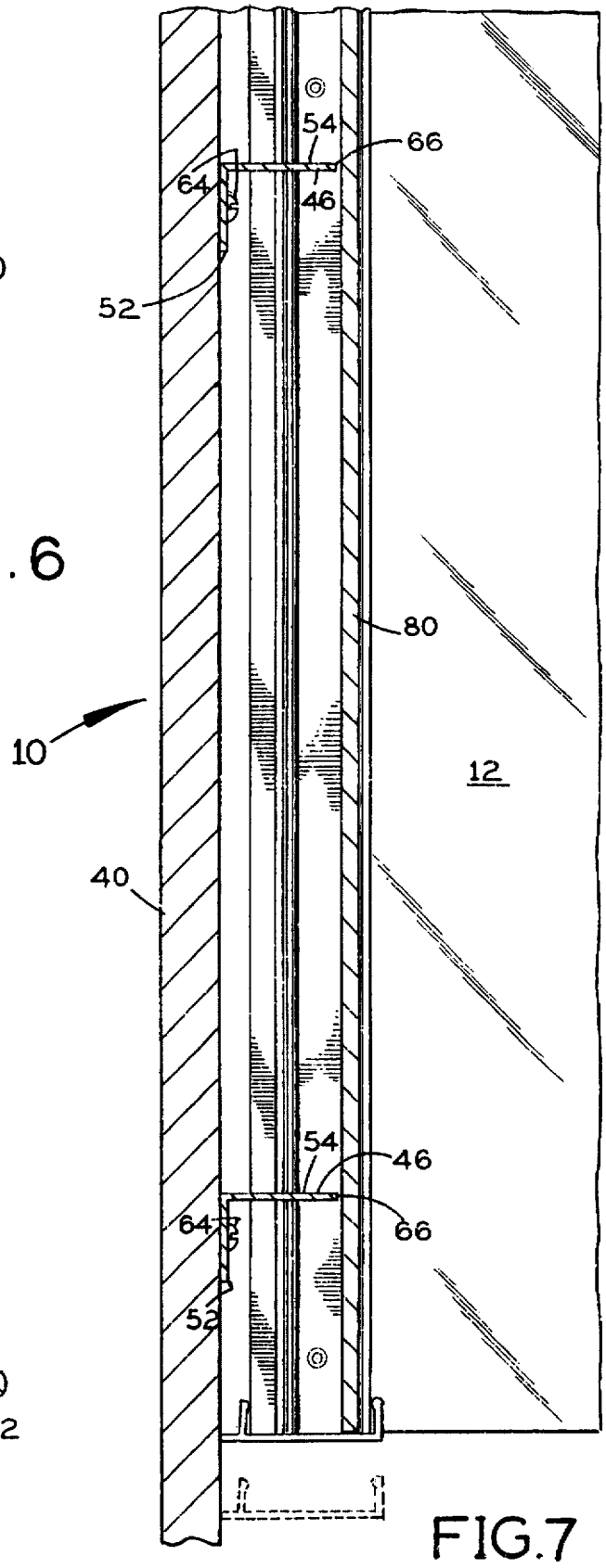
FIG. 7 is a top view of the system as shown in FIG. 6.
Figure 8:
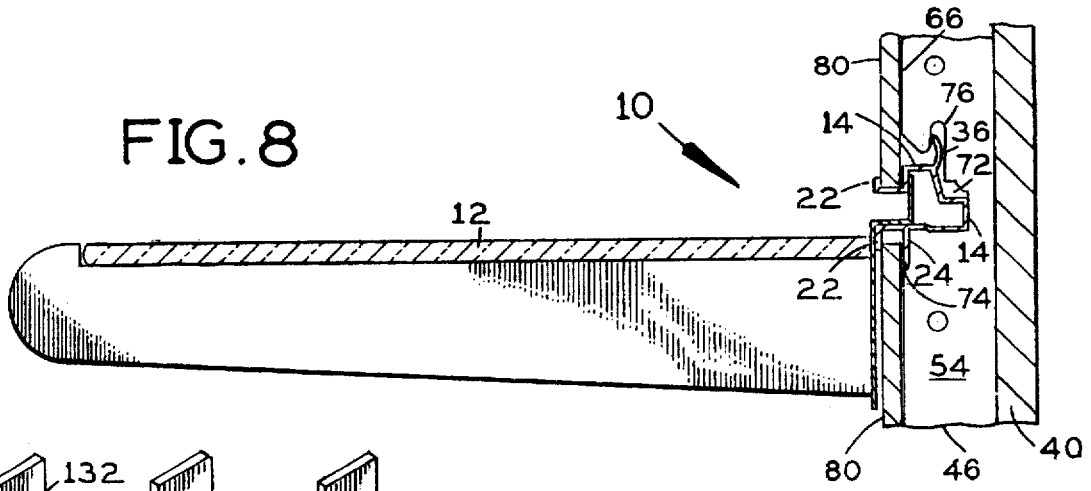
FIG. 8 is a side view of a variation of the first embodiment or which the lower anchoring structure lip flange is extended downwardly and connects to a forwardly projecting shelf bracket upon which a planar shelf member is shown resting.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Referring to FIGS. 1–8, a shelving system 10 is disclosed including several shelf members 12 with shelf member anchoring structures 14 and two shelf tracks 16, tracks 16 having a series of mutually corresponding shelf anchor engaging structures 18. Shelf tracks 16 may be one piece vertical structures, or an array of separate and discrete attachment elements.

For the first embodiment, each shelf member 12 is an elongate rectangular planar member, which is preferably made of glass. Each shelf member anchoring structure 14 is an extrusion having track engaging elements. Anchoring structures 14 each have essentially a square C-shaped portion 20 opening between mutually diverging vertical upper and lower lip flanges 22, a vertical track abutment flange 24 extending downwardly from the lower face of the C-shaped portion 20 lower horizontal segment 32, and a downward opening channel portion 26 recessed into the C-shaped portion 20 upper horizontal segment 34. See FIG. 4. A forwardly curved, vertical locking flange 36 extends upwardly from upper horizontal segment 34.

A special top-most anchoring structure 42 variation is provided in which the upper lip flange 22 extends above the level of the vertical locking flange 36. Upper lip flange 22 then angles perpendicularly to extend over vertical locking flange 36, and then downwardly where it diverges into an inverted T-portion 44. See FIG. 3. A longitudinal edge of a shelf member 12 fits snugly and removably into a narrowed region 38 at the rear of the C-shaped portion 20.

Each track 16 is preferably an L-shaped channel member 46, having various portions cut away, and attached to a backboard 40. See FIGS. 1, 2 and 5. L-shaped channel members 46 include a backboard abutment wing 52 and a shelf member engagement wing 54. Backboard abutment wing 52 includes a periodic series of longitudinal and elongate fastener receiving openings 56. Between each pair of elongate fastener receiving openings 56 is a circular fastener receiving opening 62. Fasteners 64 such as screws or bolts pass through openings 62 to secure tracks 16 to backboard 40. See FIG. 6. Exclusive use of the openings 62 permits a range of vertical track 16 adjustment during track 16 fastening. Shelf member engagement wing 54 includes a periodic series of matching cut out anchor engaging structure receptacles 18 opening out of its free edge 66. Each receptacle 18 includes a C-shaped opening region 72 for receiving the C-shaped portion 20 of an anchoring structure 14, an elongate abutment notch 74 below the C-shaped opening region 72 for receiving the track abutment flange 24, and an elongate vertical locking notch 76 opening upwardly into the top of region 72 for receiving the locking flange 36. The C-shaped opening region 72 upper forward corner is cut diagonally away to permit passing of the anchoring structure 14 into region 72 at a downward angle while hooking the locking flange 36 into locking notch 76. The bottom of anchoring structure 14 is then slid horizontally into the receptacle 18 so that anchoring structure 14 pivots within locking notch 76 to become level and fully engaged within the receptacle 18. The curved shape of locking flange 36 smoothes the pivoting section of anchoring structure 14.

The downwardly extending lower lip flange 22 of anchoring structure 14 defines a channel for receiving the upper edge of a vertical backing panel 80, and the lower edge of the panel 80 is then swung against the free edges 66 of tracks 16. The panel 80 is then slid a short distance downward along tracks 16 so that the panel 80 lower edge fits into the channel defined between the upper lip flange 22 of anchoring structure 14 and the downward opening channel portion 26 which are immediately below. See FIGS. 6 and 8. The lower lip flange 22 of the given anchoring structure 14 is of sufficient length to continue to engage the upper edge of the panel 80 against pivoting and falling forward. These panel 80 installation steps may be reversed to remove the panel 80 for apparatus 10 disassembly or reconfiguration.

Second Preferred Embodiment

A second embodiment includes anchoring structures in the form of several pairs of conventional shelf brackets 114 which removably and engagingly fit into vertical tracks 116 and retain planar shelf members 112. See FIGS. 9–12. Each shelf bracket 114 includes a horizontally elongate panel 120, having a forward end with an upright shelf retaining projection 122 and a rearward end with a track-engaging upper hook portion (not shown) and a track-engaging lower hook portion (not shown). The upper and lower hook portions each open downwardly.

Figure 10:
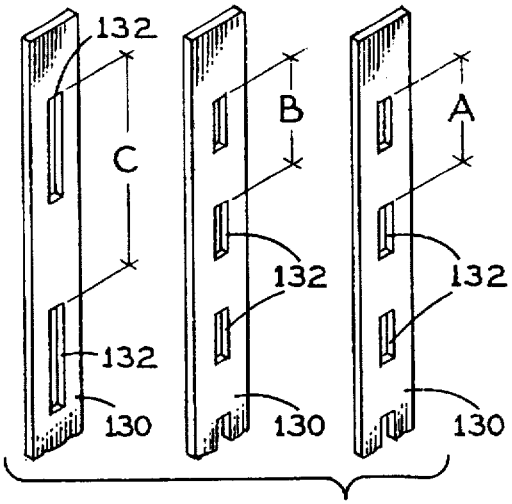
FIG. 10 is a perspective, broken away view of three elongate plates of the second embodiment having track slots of differing vertical lengths and spacings to illustrate possible design variations.
Figure 9:
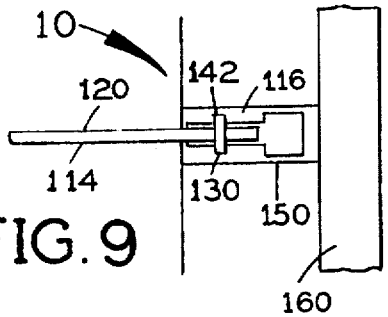
FIG. 9 is a top view of the system as shown in FIG. 12.
Figure 11:
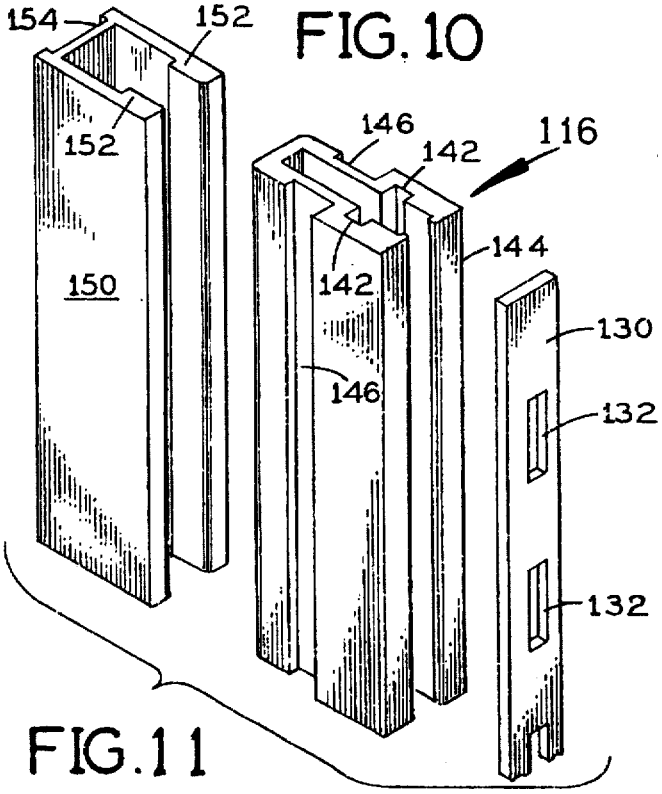
FIG. 11 is a perspective, exploded view of the elements making up the shelving tracks of the second embodiment.
Figure 12:
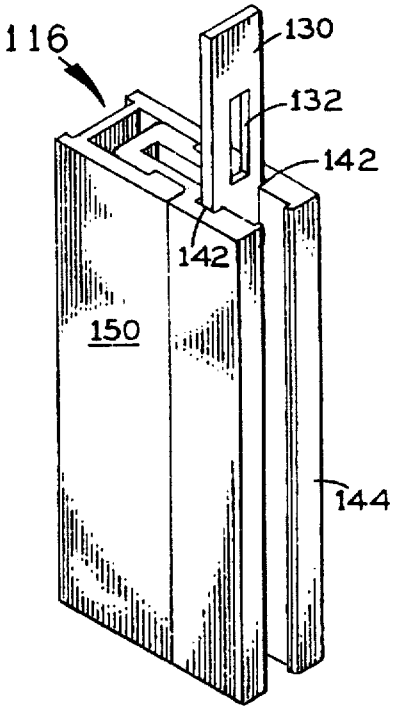
FIG.12 is a view as in FIG. 11, but with the shelving track elements assembled.

Tracks 116 each include a vertically elongate rectangular plate 130 having a periodic series of vertical elongate track slots 132. Both hook portions engagingly and snugly hook into one of a pair of track slots 132. Various slot 132 sizes and spacings are provided as needed for a given shelving application, as illustrated in FIG. 10. Each plate 130 fits longitudinally down into an opposing pair of notches 142 formed within a substantially C-shaped, extruded vertical plate-receiving structure 144. Plate-receiving structure 144 has opposing longitudinal channels 146 recessed into its outer side surfaces. Plate-receiving structure 144 in turn fits longitudinally down into an extruded, C-shaped wall-mounting structure 150. Wall-mounting structure 150 includes a pair of opposing, inwardly directed longitudinal beads 152 which engage the opposing longitudinal channels 146 in the plate-receiving structure 144. A vertical series of fasteners (not shown) are inserted through the back wall 154 of the wall-mounting structure 150 into a wall or backboard 160 to mount the system.

Third Preferred Embodiment

A third embodiment is a modular, illuminated shelving system including several hollow shelf structures 212, each including an opaque top panel 222 and containing a light source 224. Top panel 222 is alternatively translucent. Shelf structures 212 are removably fitted into a power track 210 containing an electric circuit. Track 210 is preferably, but not necessarily, separate from support tracks 216. See FIGS. 13–22.

Each shelf structure 212 is either open underneath or more preferably includes a translucent bottom panel 226 which is spaced downwardly from top panel 222. Opaque, preferably metal, shelf brackets 232 receive and retain within receiving channels 234 extending along their inner faces 236 the top and bottom panels 222 and 226, respectively, in their spaced apart configuration. Brackets 232 are alternatively translucent. An opaque channel-shaped forward nose piece 240, preferably having a semi-circular cross-section, is secured over the forward longitudinal edges of panels 222 and 226. Forward nose piece 240 includes opposing, slotted plate receiving beads 242 extending along the inside of each longitudinal edge. Plate receiving beads 242 preferably each have a stem-mounted, C-shaped cross-section and open in the direction of the opposing bead 242. See FIG. 14. The longitudinal edges of top and bottom panels 222 and 226, respectively, each fit against a bead 242 stem portion 244, snugly between forward nose piece 240 and the C-shaped bead portion 246.

Figures 17, 18:
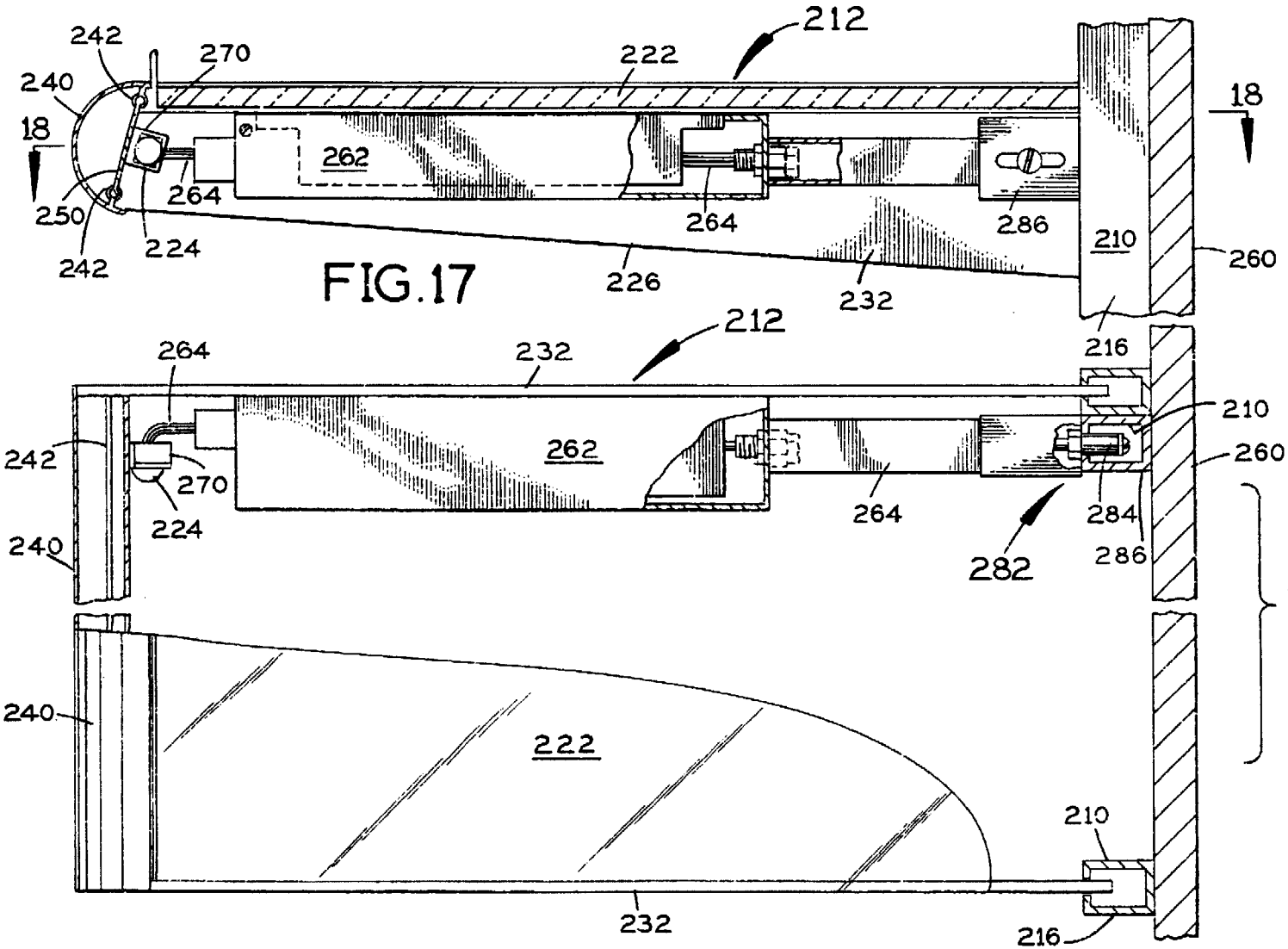
FIG. 17 is a view as in FIG. 15 of a variation of the third embodiment, having a halogen bulb ballast, metal tube plug and an elongate channel receptacle.
FIG. 18 is a view as in FIG. 16 of the metal tube plug variation.
Figure 19:
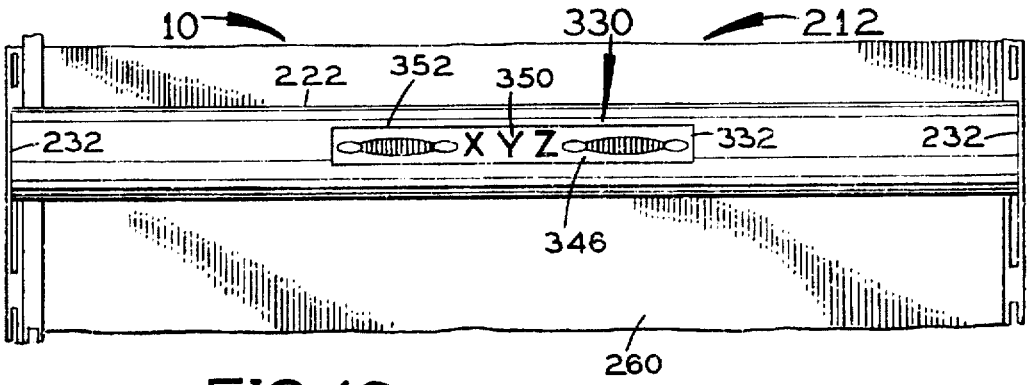
FIG. 19 is a front view of a shelf structure of the third embodiment having the optional illuminated sign display feature.
Figure 20:
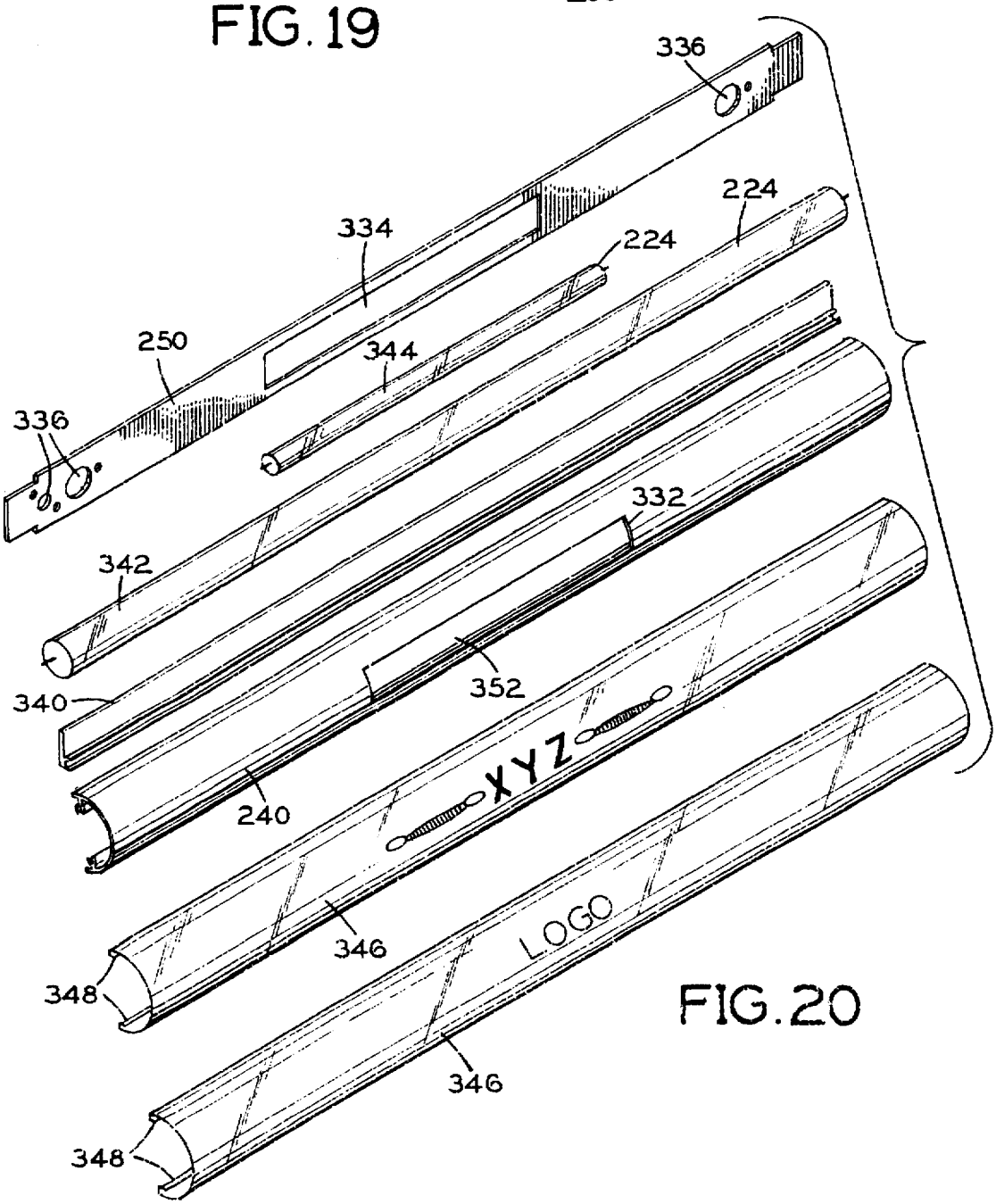
FIG. 20 is an exploded view of the FIG. 19 shelf structure.

An elongate bulb mounting plate 250 is fitted longitudinally into the bead 242 openings and is of sufficient width to be retained by beads 242. A pair of longitudinally spaced apart bulb mounting socket structures 270 protrude from mounting plate 250 toward the shelf mounting track 210 and mounting backboard 260. Along one of the shelf brackets 232 extends a conventional fluorescent bulb ballast structure 262, circuit wires 264 extending from the ballast structure 262 to the nearest socket structure 266, and from the ballast structure 262 to a track circuit engaging plug 272 having conductive prongs 274. Prong receiving receptacles are provided periodically along the track 210 and are connected to the track circuit. See FIGS. 15 and 16. An alternative halogen ballast and plug 282 structure is illustrated in FIGS. 17 and 18, having a conductive tube 284 mounted with an axially extending screw, which fits at any point into a single, elongate channel receptacle 286 having a C-shaped cross-section. As the tube 284 is inserted into the channel receptacle 286, the sides of the conductive tube 284 make electrical contact the open edges of the channel 286. In addition to the electric power track 210, at least two support tracks 216 are preferably provided having either a conventional construction or the construction of the above-described second embodiment.

Figures 13, 14, 23:
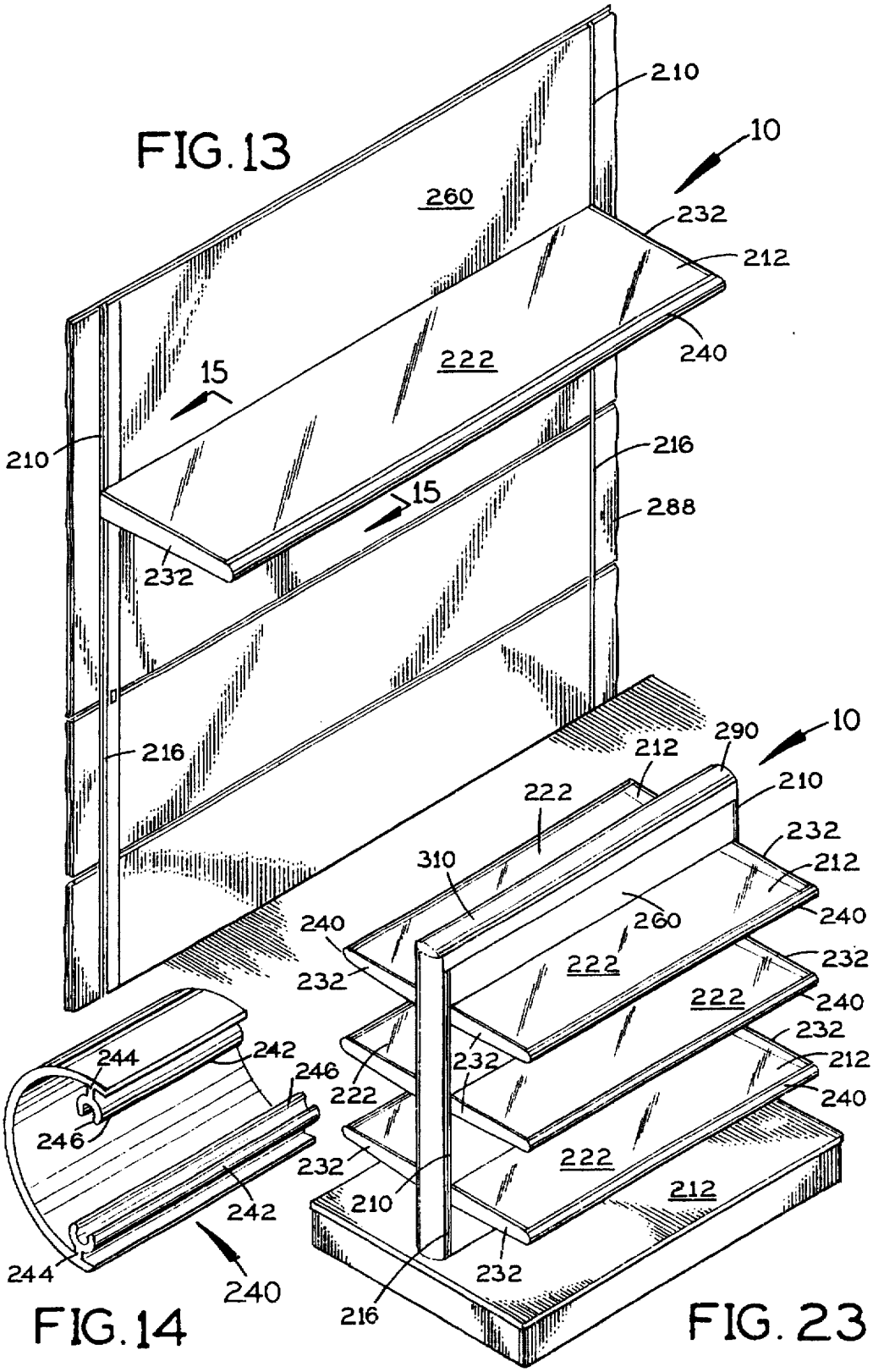
FIG. 13 is a perspective view of the modular, illuminated shelving system of the third embodiment mounted to a wall or backboard.
FIG. 14 is a perspective, broken away view of an end of a forward nose piece of the third embodiment, revealing the preferred slotted bead structure.
FIG. 23 is a perspective view of the shelving system of FIG. 13, but shown mounted to a free-standing backboard support structure.
Figure 15:
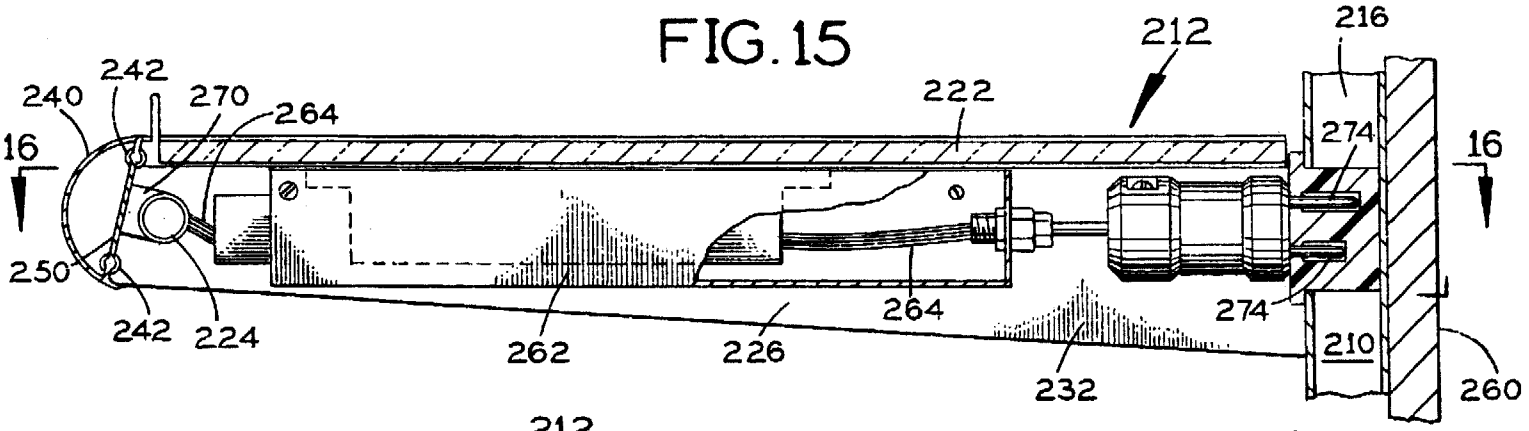
FIG. 15 is a cross-sectional side view of the shelf structure of the third embodiment showing the forward nose piece, fixture plate, fluorescent bulb ballast and electric plug, and a power track plug receptacle.
Figure 16:
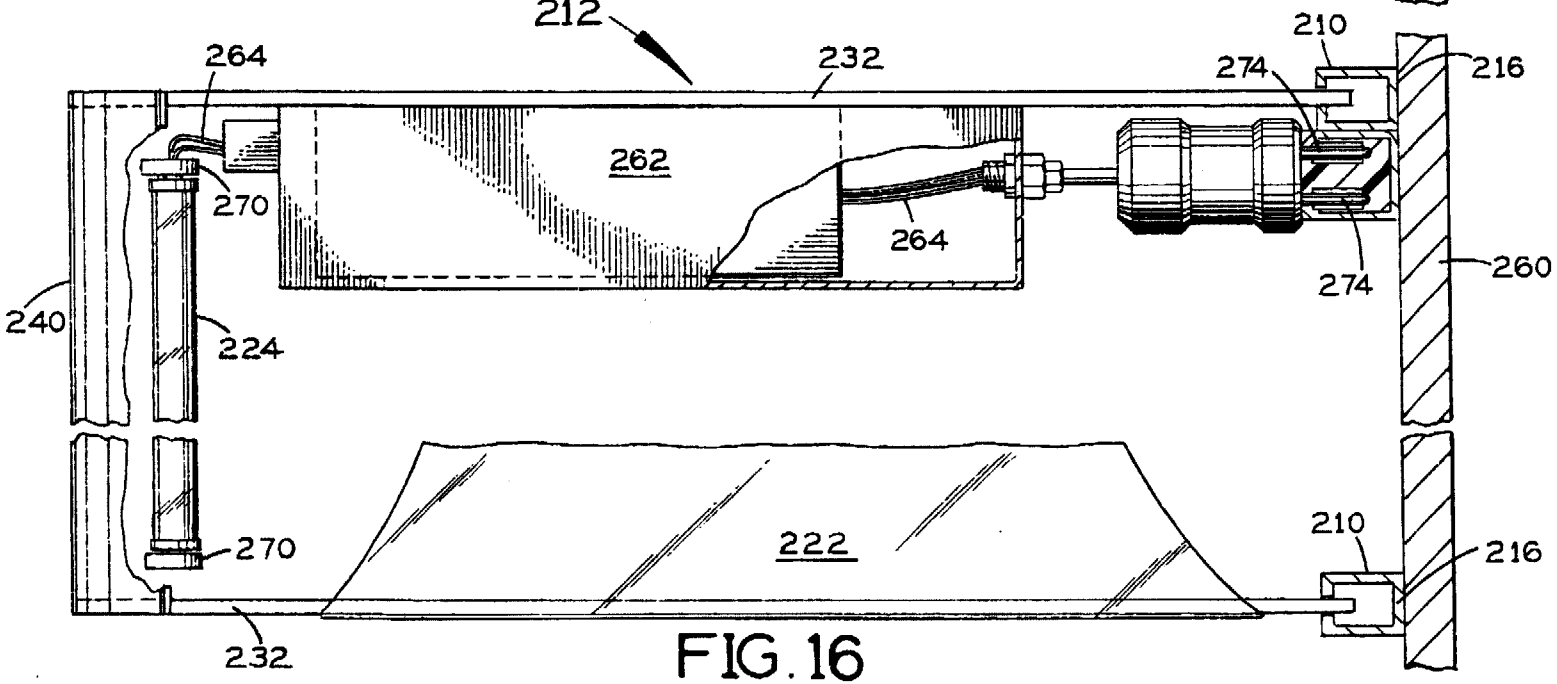
FIG. 16 is a sectional top view of the shelving system of FIG. 15.

These illuminated shelf structures may be secured to a wall 288, as shown in FIG. 13, or to a free standing display structure 290, as shown in FIG. 23. The forward edges of the top and bottom panels 222 and 226 and forward nose piece 240 may be correspondingly bowed outwardly for style purposes. See FIG. 21.

Figures 21, 22:
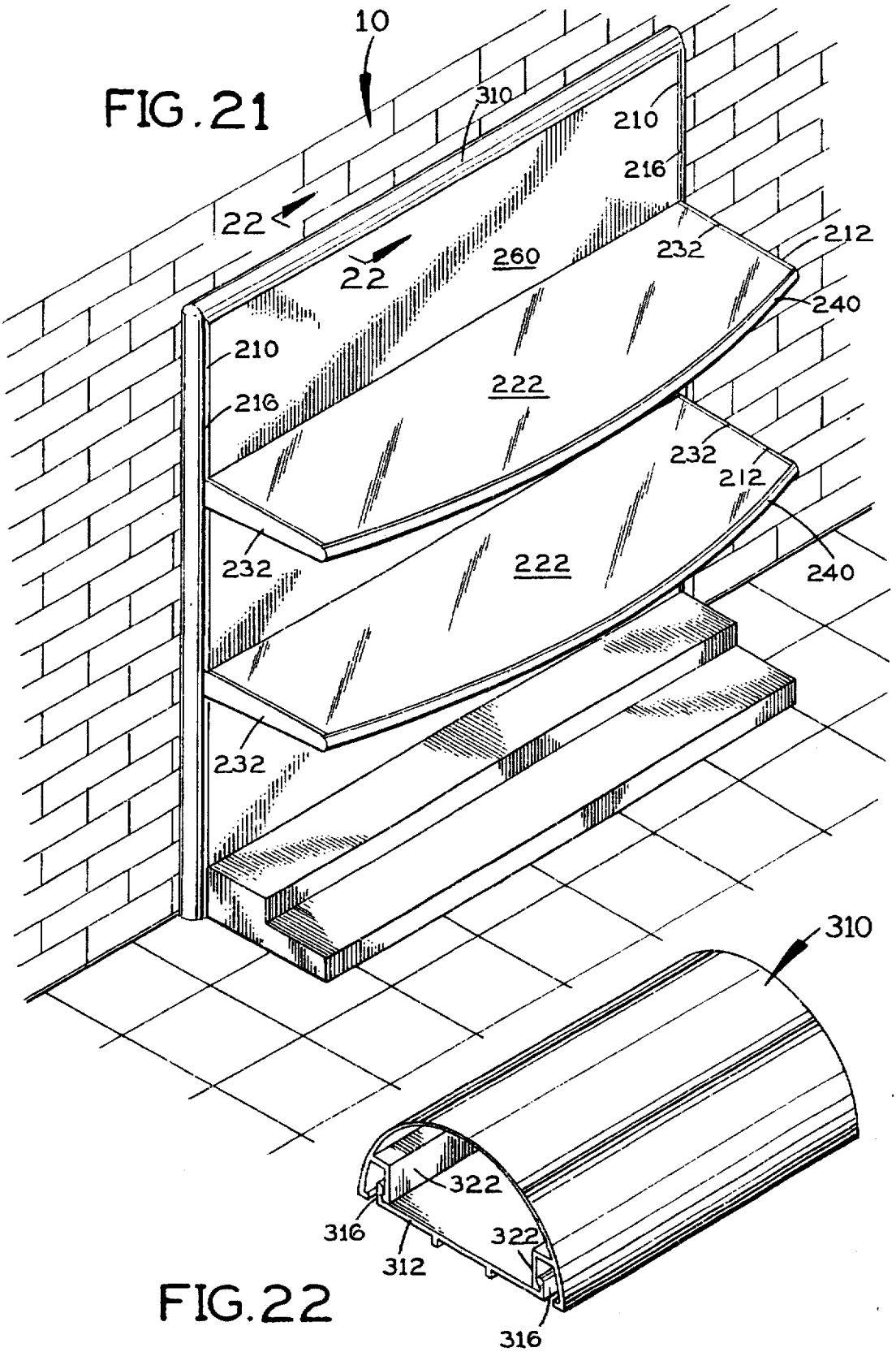
FIG. 21 is a perspective view of the third embodiment having the outwardly curved forward nose piece feature.
FIG. 22 is a broken away portion of the top nose piece and plate.

A preferred support structure top nose piece 310 is illustrated in FIG. 22, also in the form of a channel having a semicircular cross-section. An anchoring plate 312 is provided along the top of the support structure 260 or display structure 290, having upturned and inwardly curved flanges 316 along each longitudinal edge. A pair of angled engaging flanges 322 are provided within each longitudinal edge of the top nose piece 310. Engaging flanges 322 each have an outwardly directed hook portion 324 which engages the curved anchor flanges 316 along anchoring plate 312. The top piece 250 is engagingly slid longitudinally along the anchoring plate so that the engaging flanges 322 engage the plate anchor flanges 316.

A variation of the third embodiment is provided including an illuminated word or design display 330 along the forward end of the individual shelf structure 212. See FIG. 19. For this variation, the opaque forward nose piece 240 and the plate 250 include matching and registering longitudinally extending rectangular openings 332 and 334, respectively. See the exploded view of FIG. 20. Wire and fastener passing ports 336 are provided near each end of plate 250 for both preferred versions of this embodiment. The upwardly directed shelf lip 340 may be provided as a separate piece, as illustrated. A fluorescent bulb 342 and the alternative halogen bulb 344 are shown. A label and sign channel 346 of semi-circular cross-section and made of translucent plastic is provided which fits snugly over forward nose piece 240. The label and sign channel 346 includes longitudinal lips 348 which engagingly snap over and around the rear edges of forward nose piece 240. Opaque or dark translucent letters or designs 350 are provided on sign channel 346 within a display region 352 of the channel 346. Display region 352 registers with the forward nose piece rectangular opening 332. Light from the fluorescent bulb 342 is not only radiated out of the open underside of each shelf structure 212 or through lower translucent panels 226, but additionally or alternatively radiates through the region 352 and produces an illuminated sign conspicuously displaying the selected letters, words or designs 350. These may identify the items on the shelf structure 212 by type or by brand name, or may display a brand or store trademark, a logo or an ornamental pattern. The design 350 may be altered conveniently by simply detaching the particular sign channel 346 and replacing it with another having other matter in its display region 352.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A shelving system, comprising:

a power track including an electric circuit connected to a power source, and at least one shelf structure including a top panel having a forward longitudinal edge and containing a light source beneath said top panel to radiate light below said shelf structure, said shelf structure being removably fitted to said power track such that said light source is electrically connected to said electric circuits, wherein said shelf structure comprises a pair of laterally spaced apart shelf brackets having means for receiving and retaining said top panel, a forward nose piece secured over the forward longitudinal edge of said top panel, said forward nose piece including at least two opposing, plate receiving beads, each said bead having a longitudinal slot opening toward the opposing said bead, such that the forward longitudinal edge of said top panel fits against said beads, an elongate light source mounting plate fitted longitudinally and engagingly into the slots in said opposing plate receiving beads beneath said top panel, a pair of spaced apart bulb mounting socket structures projecting from said mounting plate and a light source ballast structure, and circuit means having conductive shelf coupling means and extending from said ballast structure to one said socket structure, and from said ballast structure to said power source.

2. A shelving system, comprising:

a power track including an electric circuit connected to a power source, and at least one shelf structure including a top panel having a forward longitudinal edge and containing a light source beneath said top panel to radiate light below said shelf structure, said shelf structure being removably fitted to said power track such that said light source is electrically connected to said electric circuit, wherein said shelf structure comprises a translucent bottom panel having a forward longitudinal edge and spaced downwardly from said top panel, a pair of laterally spaced apart shelf brackets having means for receiving and retaining said top and bottom panels in said spaced apart relationship, a forward nose piece secured over the forward longitudinal edges of said top and bottom panels, said forward nose piece including at least two opposing, plate receiving beads, each said bead having a longitudinal slot opening toward the opposing said bead, such that the forward longitudinal edges of said top and bottom panels each fit against said beads, an elongate light source mounting plate fitted longitudinally and engagingly into the slots in said opposing plate receiving beads, a pair of longitudinally spaced apart bulb mounting socket structures projecting inwardly from said mounting plate, a light source ballast structure, and circuit means extending from said ballast structure to one said socket structure, and from said ballast structure to said power source having conductive shelf coupling means.

3. A shelving system according to claim 2, wherein said shelf brackets are translucent.

4. A shelving system according to claim 2, wherein said power source is an electric power track.

5. A shelving system according to claim 2, additionally comprising at least two shelf structure support tracks.

6. A shelving system according to claim 2, wherein the forward longitudinal edges of said top and bottom panels and said forward nose piece are correspondingly bowed outwardly.

7. A shelving system according to claim 2, wherein said forward nose piece comprises an opening defining a display region and a translucent member extending over said opening and marked with a design which is illuminated by said light source.

8. A shelving system according to claim 2, wherein said forward nose piece has rear edges, and wherein said forward nose piece and said plate have registering display openings, additionally comprising:

a light source bulb, a translucent sign channel which fits snugly over said forward nose piece, including longitudinal lips which engagingly snap over and around the rear edges of said forward nose piece, a design on a region of said sign channel registering with, said forward nose piece opening, such that light from said bulb is radiated through said region and illuminates said design.

9. A shelving system according to claim 8, wherein said light source bulb is a fluorescent bulb.

10. A shelving system, comprising:

a power track including an electric circuit connected to a power source, and at least one shelf structure including a top panel having a forward longitudinal edge and containing a light source beneath said top panel to radiate light below said shelf structure, said shelf structure being removably fitted to said power track such that said light source is electrically connected to said electric circuit, wherein said shelf structure comprises a translucent bottom panel having a forward longitudinal edge and being spaced downwardly from said top panel and located beneath said light source, a pair of laterally spaced apart shelf brackets having means for receiving and retaining said top and bottom panels in said spaced apart relationship, a forward nose piece secured over the forward longitudinal edges of said top and bottom panels with forward nose piece securing means, and circuit means extending from said light source to said power source having conductive shelf coupling means.

* * * * *